United States Patent [19]

Heaton

[11] 4,114,941

[45] Sep. 19, 1978

[54] CARGO HANDLING DEVICE

[76] Inventor: Michael H. Heaton, Thurston Rd., Gloucester, Mass. 01930

[21] Appl. No.: 808,108

[22] Filed: Jun. 20, 1977

[51] Int. Cl.[2] ..... B66C 1/22

[52] U.S. Cl. ..... 294/86 R; 214/620; 280/24

[58] Field of Search ..... 294/86 R, 81 R, 78 R, 294/92, 16; 280/24, 19; 214/620

[56] References Cited

U.S. PATENT DOCUMENTS

| | | | |
|---|---|---|---|
| 3,073,613 | 1/1963 | Bergstrom, Jr. | 294/86 R |
| 3,779,571 | 12/1973 | Ahmling | 280/24 |
| 3,791,544 | 2/1974 | Moses | 214/620 |

*Primary Examiner*—James B. Marbert

*Attorney, Agent, or Firm*—Wolf, Greenfield & Sacks

[57] ABSTRACT

A crate grappling device having a generally U-shaped frame including a pair of coplanar arms and a cross member connected to the arms at one end. A pair of hook-like members are secured to the free ends of the arms, which are adapted to engage the wooden frame structure of a palletized crate so that with the aid of a winch or some other pulling device the crate may be dragged along the bed of a truck or trailer to the tailgate. Formed as an integral part of the hook-like members are skids which bear the wear of the grappling device as it is dragged along the bed.

4 Claims, 6 Drawing Figures

CARGO HANDLING DEVICE

INTRODUCTION

This invention relates to grapnels and more particularly comprises a crate grappling device particularly designed to move palletized crates in trucks and trailers to the tailgate.

At the present time large palletized crates transported in trailers are commonly dragged to the rear of the trailer by tying a heavy rope about the crates and dragging them rearwardly in the trailer typically by means of a winch carried by the trailer. Thereafter, the palletized crates are removed from the trailer by means of a fork lift. This procedure is time consuming and is often destructive to the crate contents. The crates themselves frequently are made of nothing more than corrugated paper supported on a wooden pallet, and the rope bound about the crates frequently crushes them. No means is ordinarily provided for readily tying the rope to the palletized base of the crate, and, therefore, there is no means for utilizing the strength of the pallet to avoid crushing the crate. By means of the present invention the operation of securing a rope about the crate is eliminated, and the crate is dragged on the trailer bed by means of a grapnel which engages only the pallet of the crate and not the corrugated paper. Therefore, no stress is applied to the corrugated portion of it.

The grapnel of this invention is of very strong design and is capable of being slipped in place under the leading cross beam between the pallet joists. Skids are provided on the grapnel for bearing the wear imposed on the device, and the skids also serve to reduce the friction between the grapnel and the deck as the crate is pulled into position. Thus, this device makes it easier to move the crates in the trailer, reduces the likelihood for damaging the crate contents, and generally accelerates the task of unloading the trailer.

This invention will be better understood and appreciated from the following detailed description of one embodiment thereof, selected for purposes of illustration and shown in the accompanying drawing.

BRIEF FIGURE DESCRIPTION

DETAILED DESCRIPTION

Figure 1:
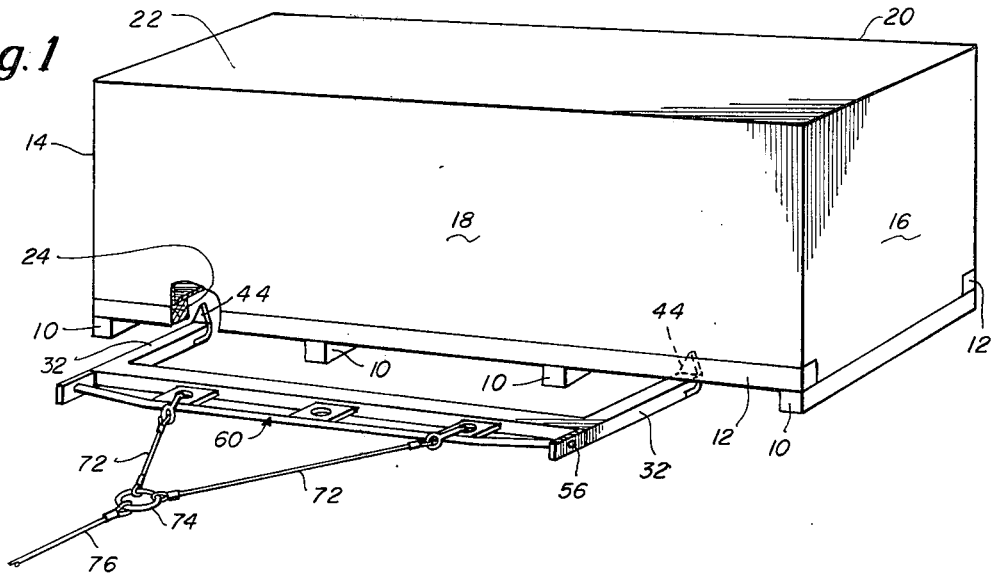
FIG. 1 is a perspective view of a palletized crate engaged by a grapnel constructed in accordance with this invention to be dragged on the bed of a trailer.

The grapnel shown in the drawing is particularly designed to move palletized crates in trucks and trailers to the tailgate where the crates may be removed by any conventional fork lift. A typical palletized crate is shown in FIG. 1 having a series of joists 10 which support a pair of cross beams 12. The crate is essentially made up of corrugated walls 14, 16, 18, 20 and 22 that are erected above the joists and cross beams. The crate shown is like those used to ship motorcycles. The grapnel is intended to engage the cross beam 12 between the joists 10 and act as a runner to slide the crate to the tailgate.

Figure 3:
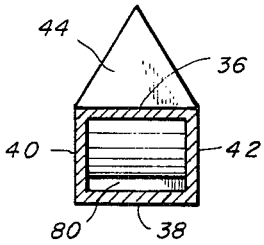
FIGS. 3, 4 and 5 are cross sectional views taken on the corresponding section lines in FIG. 2.
Figure 5:
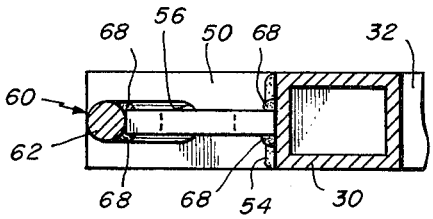

The grapnel itself includes a U-shaped frame 30 having a pair of arms 32 that extend rearwardly from the ends of the cross member 34. Preferably, the U-shaped frame 30 is approximately one meter wide from arm to arm and is made of tubular rectangular stock approximately $1\frac{1}{2}$ inches wide and $\frac{3}{4}$ inches high and having a wall thickness of about $\frac{1}{8}$ inch. As suggested in FIG. 3, the horizontal walls 36 and 38 are of greater width dimension than the vertical walls 40 and 42.

Figure 4:
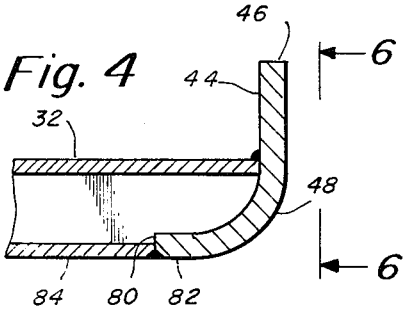
Figure 6:
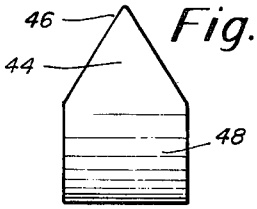
FIG. 6 is a rear elevation view of one arm of the grapnel looking in the direction of sight lines 5—5 of FIG. 4.

An upwardly extending hook 44 is secured to the rear end of each arm 32. The hook has an upper pointed section 46 and a lower curved section 48 that forms a skid or runner for the grapnel. As shown in FIG. 1, the upper section 46 of the device is intended to engage the rear side 24 of the cross beam 12 so as to drag the crate rearwardly in the truck or trailer to the tailgate. As is clear in FIG. 4, the lower portion 48 of the hook is provided with a radius so that when the front end of the grapnel is lifted, there is only substantially line contact between the lower section 48 of the barb and the deck of the truck or trailer so that it may slide readily on the bed when the grapnel is pulled. The hook typically is made from $\frac{1}{4}$ inch stock and is capable of withstanding the great stresses to which the grapnel is regularly subjected in use.

Figure 2:
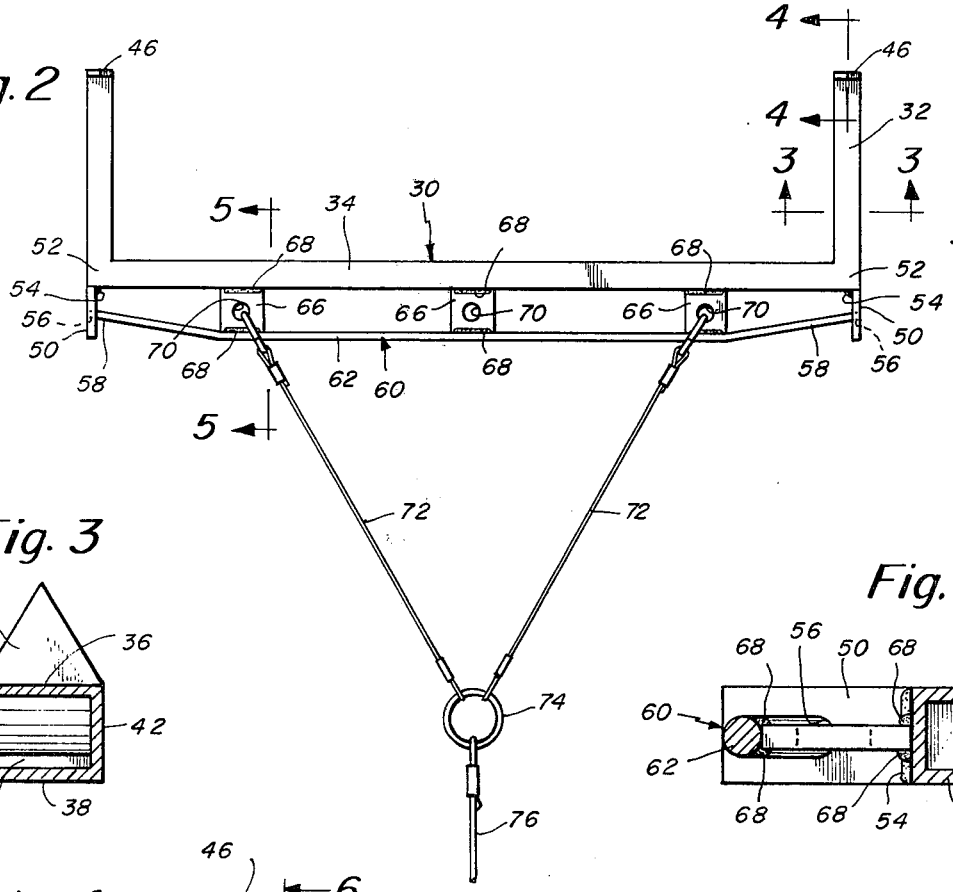
FIG. 2 is a plan view of the grapnel.

A pair of side plates 50 are welded to the ends 52 of the cross member 34 as suggested at 54 and extend in a direction opposite that of arms 32. Each plate 50 is also made of heavy steel stock similar to that from which the hooks 44 are made, and it has a hole 56 as shown in FIG. 2, which receives the end 58 of the front bar 60. The bar 60 is generally a straight member throughout its length except that its ends 58 are turned rearwardly somewhat toward the U-shaped frame. The major portion 62 of the bar extends parallel to the cross member 30 as suggested in FIGS. 1 and 2.

The bar 60 typically is made of round stock and is spaced from the cross member approximately $1\frac{3}{4}$ inches. In the embodiment shown three anchor plates 66 are welded to cross member 34 and bar 60 as suggested at 68, and each plate has a hole 70 that may be engaged by the ends of a wire sling 72 which in turn is provided with a ring 74 adapted to be pulled by a heavy rope 76 secured to a fork lift or winch to drag the grapnel with the crate to the tailgate.

While in FIG. 1 the grapnel is shown secured to the crate so that the grapnel itself is centered with the center line of the crate, on some occasions because of the construction of the pallet, it is not possible to place the grapnel centered as shown. In that event, to prevent the crate from turning as it is dragged to the rear of the truck or trailer, the user may wish to connect the wire sling to other than the two outside anchor plates as shown in FIG. 1. For example, he may utilize the center anchor plate and one or the other of the side anchor plates. Alternatively he may connect a line to one of the outside anchor plates alone. In this fashion, the line 76 may be aligned with the center of mass of the crate even though the grapnel itself is not centered with respect to the crate.

In use, the grapnel is slipped under the cross beam 12 by raising the cross member 34 so that the tips of the hooks can slide under the beam 12 and engage the rear surface thereof as suggested in the drawing. The cross member is then dropped to the deck of the truck or trailer, the sling 72 is suitably attached to one or more of the anchor plates, to slide the crate along the deck. When the line 76 is pulled, the cross member 30 may lift off the ground slightly so as to cause the grapnel to contact the deck only at the runners 48 which form part of the hook members at the rear of each arm. In that fashion friction is minimized and the front of the crate is lifted off the deck so that it may be dragged along the deck without difficulty. It will be noted that the leading edge 80 of the runner section 48 of the hook is mounted so that its lower surface 82 is coplanar with the lower surface 84 of the arm to which it is secured. Consequently there is no step or other protrusion at the forward edge 80 which could snag on the deck or otherwise impede dragging of the crate.

From the foregoing description those skilled in the art will appreciate that numerous modifications may be made of this invention without departing from its spirit. Therefore I do not intend to limit the scope of this invention to the embodiment shown and described. Rather, the scope of this invention is to be determined by the appended claims and their equivalents.

What is claimed is:

1. A crate grappling device comprising a generally U-shaped frame including a pair of coplanar arms and a cross member interconnecting the arms at one end thereof, a pair of hook-like members, one secured to the other end of each of the arms and extending in the same direction from the plane of the arms, a plurality of line anchors spaced along the cross member enabling the user to selectively secure a line to the device, and a curved skid secured to the ends of each of the arms on the sides opposite the hook-like members, said skids and hook-like members being formed as an integral unit with the skids defining a radius at the end of each arm, whose center of curvature is parallel to said cross-member.

2. A crate grappling device as described in claim 1 further characterized by said U-shaped frame being made of tubular stock having a rectangular cross-section.

3. A crate grappling device as described in claim 1 further characterized by a pair of plates secured to the frame adjacent the intersection of the arms and cross member, said plates extending in a direction opposite that of the arms, and a bar connected at its ends to the plates and extending generally along but spaced from the cross member, said anchors being secured to the bar and cross member.

4. A crate grappling device as described in claim 3 further characterized by said anchors being in the form of a plate welded to the bar and cross member.

* * * * *